US009002227B2

(12) United States Patent
Ohno et al.

(10) Patent No.: US 9,002,227 B2
(45) Date of Patent: Apr. 7, 2015

(54) IMAGE FORMING APPARATUS

(71) Applicant: Canon Kabushiki Kaisha, Tokyo (JP)

(72) Inventors: Masaru Ohno, Ebina (JP); Shinji Katagiri, Yokohama (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/050,565

(22) Filed: Oct. 10, 2013

(65) Prior Publication Data

US 2014/0105626 A1 Apr. 17, 2014

(30) Foreign Application Priority Data

Oct. 16, 2012 (JP) ..... 2012-229249

(51) Int. Cl.
*G03G 15/16* (2006.01)
*G03G 15/00* (2006.01)

(52) U.S. Cl.
CPC ..... *G03G 15/80* (2013.01); *G03G 15/1645* (2013.01); *G03G 15/1675* (2013.01)

(58) Field of Classification Search
CPC ..... G03G 15/80
USPC ..... 399/66, 129, 101
See application file for complete search history.

(56) References Cited

U.S. PATENT DOCUMENTS

2009/0232530 A1* 9/2009 Saito et al.
2009/0311002 A1* 12/2009 Shibuya et al. ..... 399/101
2013/0195519 A1 8/2013 Ito et al.

FOREIGN PATENT DOCUMENTS

JP 10-240030 A 9/1998
JP 11-161051 A 6/1999
JP 2001-175092 A 6/2001
JP 2009-205012 A 9/2009
JP 2012-137733 A 7/2012

* cited by examiner

*Primary Examiner* — Susan Lee
(74) *Attorney, Agent, or Firm* — Fitzpatrick, Cella, Harper & Scinto

(57) ABSTRACT

A control unit is provided which controls at least one of a first power supply unit (a secondary transfer power supply connected to a secondary transfer roller) and a second power supply unit (high-voltage power supplies connected to a conductive brush and a conductive roller) so that a current supplied to a primary transfer region from a beginning of primary transfer until a beginning of secondary transfer has a magnitude larger than a magnitude of a current supplied to the primary transfer region from a beginning of image formation until the beginning of the primary transfer.

13 Claims, 12 Drawing Sheets

IMAGE FORMING APPARATUS

BACKGROUND OF THE INVENTION

1. Field of the Invention

The present invention relates to an image forming apparatus, for example, a copier or a printer, which has a function of forming an image on a recording material such as a sheet.

2. Description of the Related Art

As an image forming apparatus such as a copier or a laser printer, an image forming apparatus configured to use an intermediate transfer member has been known.

In such an image forming apparatus, first, a primary transfer step is carried out in which, with a toner image formed on a surface of a drum-like electrophotographic photosensitive member (hereinafter referred to as a photosensitive drum), a primary transfer member disposed opposite the photosensitive drum is supplied with a voltage by a high-voltage power supply to transfer the toner image to an intermediate transfer member. Then, the primary transfer step is repeatedly carried out for a plurality of toner images in respective colors to form a plurality of toner images in the respective colors on the surface of the intermediate transfer member. Subsequently, in a secondary transfer step, a secondary transfer member is supplied with a voltage by the high-voltage power supply to transfer all of the plurality of toner images in the respective colors formed on the intermediate transfer member to a surface of a recording material such as paper at a time. Then, fixing means fixes the toner images to the recording material to form a color image on the recording material.

Japanese Patent Application Laid-open No. 2001-175092 discloses a configuration in which a current is passed through the intermediate transfer member in a circumferential direction thereof via a transfer member in contact with an inner peripheral surface of the intermediate transfer member or a tensing member tensing the intermediate transfer member to carry out the primary transfer step by the current flowing through the intermediate transfer member in the circumferential direction thereof. However, Japanese Patent Application Laid-open No. 2001-175092 may fail to sufficiently supply the current needed for the primary transfer step, resulting in an inappropriate image.

SUMMARY OF THE INVENTION

An object of the present invention is to pass a current through an intermediate transfer member in a circumferential direction thereof to achieve the optimum primary transfer by the current flowing through the intermediate transfer member in the circumferential direction thereof.

To accomplish this object, an image forming apparatus according to the present invention includes:

an image bearing member on which a toner image is formed;

an intermediate transfer member that is endless and rotatable, the intermediate transfer member being disposed in contact with the image bearing member and forming a primary transfer region between the intermediate transfer member and the image bearing member, a toner image formed on the image bearing member being primarily transferred, at the primary transfer region, to the intermediate transfer member;

a transfer member disposed in contact with the intermediate transfer member and forming a secondary transfer region between the transfer member and the intermediate transfer member;

a first power supply unit connected to the transfer member;

a charging member provided downstream of the secondary transfer region in a rotating direction of the intermediate transfer member and upstream of the primary transfer region to charge toner remaining on the intermediate transfer member;

a second power supply unit connected to the charging member; and a control unit controlling at least one of the first power supply unit and the second power supply unit, wherein the control unit controls at least one of the first power supply unit and the second power supply unit so that a current supplied to the primary transfer region from a beginning of primary transfer until a beginning of secondary transfer has a magnitude larger than a magnitude of a current supplied to the primary transfer region from a beginning of image formation until the beginning of the primary transfer, and the first power supply unit and the second power supply unit pass a current from the transfer member and the charging member to the image bearing member via the intermediate transfer belt to carry out the primary transfer.

Further features of the present invention will become apparent from the following description of the exemplary embodiments (with reference to the attached drawings).

DESCRIPTION OF THE EMBODIMENTS

Embodiments of the present invention will be described below in an illustrative manner with reference to the drawings. However, the sizes, materials, shapes, relative arrangements, and the like of components described in the embodiments should be properly changed according to the configuration of an apparatus to which the invention is applied or any of various conditions, and are not intended to limit the scope of the present invention to the embodiments described below.

The present invention relates to an image forming apparatus such as a copier or a printer which is based on an electrophotographic system or an electrostatic recording system and which adopts an intermediate transfer system transferring a toner (developer) image formed on an image bearing member to an intermediate transfer member and then to a recording material.

<Embodiment 1>

(Image-Forming System)

Figure 1:
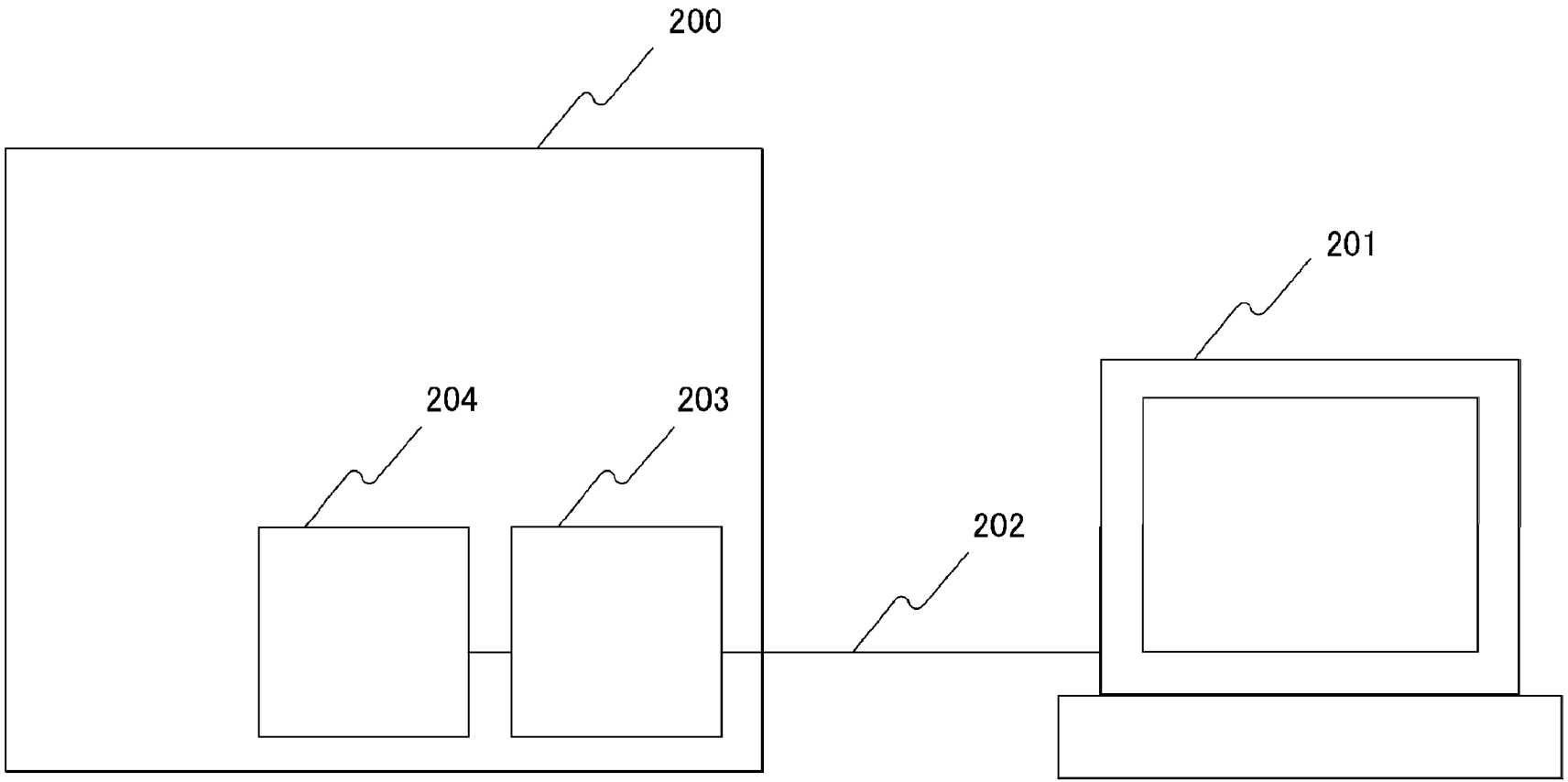
FIG. 1 is a diagram of an image-forming system showing a connection between an image forming apparatus and an image transmission apparatus according to Embodiment 1.

FIG. 1 is a diagram of an image-forming system showing a connection between an image forming apparatus and an image transmission apparatus according to Embodiment 1.

An image forming apparatus 200 according to Embodiment 1 is, as shown in FIG. 1, connected to an information apparatus 201 such as a PC via a cable 202. When the information apparatus 201 transmits an image signal to the image forming apparatus 200, an image processing unit 203 in the image forming apparatus 200 analyzes the received signal and transmits the analyzed signal to a control unit 204. The control unit 204 controls units of the image forming apparatus in accordance with information analyzed by the image processing unit 203.

(Operation of the Image Forming Apparatus)

Figure 2:
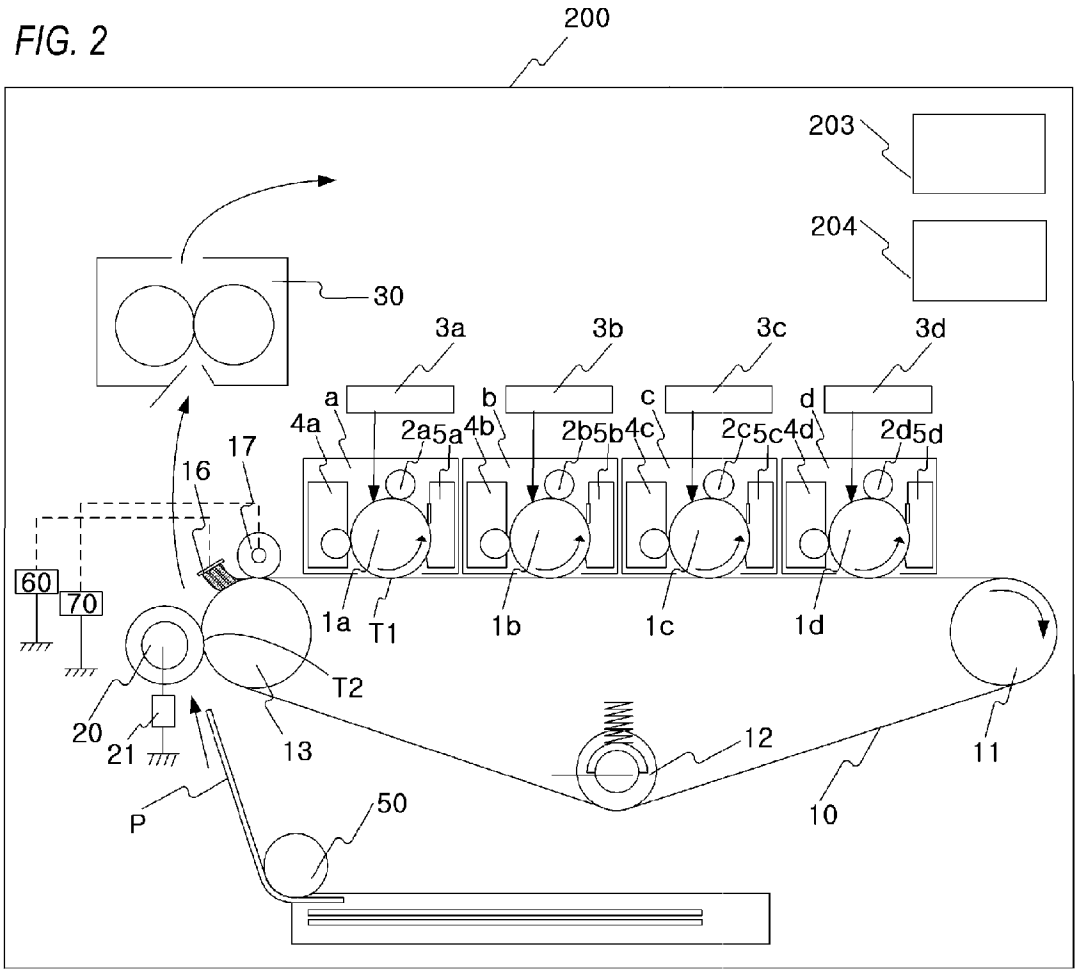
FIG. 2 is a cross-sectional view showing a general configuration of the image forming apparatus according to Embodiment 1.

FIG. 2 is a cross-sectional view showing a general cross-sectional view of the image forming apparatus 200 according to Embodiment 1.

The configuration and operation of the image forming apparatus 200 according to Embodiment 1 will be described below with reference to FIG. 2.

The image forming apparatus 200 according to Embodiment 1 adopts the intermediate transfer system and includes a plurality of image-forming stations (image-forming units) provided along a rotating direction of an endless, rotatable intermediate transfer member (hereinafter referred to as an intermediate transfer belt) 10. According to Embodiment 1, the image-forming stations include a first image-forming station (a) to a fourth image-forming station (d). The first to fourth image-forming stations (a) to (d) perform an image-forming operation using toner in yellow (Y), magenta (M), cyan (C), and black (Bk) colors, respectively.

Now, the image-forming operation will be described. The image-forming operation of the first image-forming station (a) will be described below. However, the configurations and operations of the image-forming stations are substantially the same except for the color of the toner used. The suffixes (a), (b), (c), and (d), which are appended to the reference numerals in FIG. 2 in order to indicate to which of the colors the element is intended, are hereinafter omitted unless any specific distinction is required and the image-forming operation will be generally described.

The image forming apparatus 200 includes a photosensitive drum 1 as an image bearing member. The photosensitive drum 1 is rotationally driven in the direction of an arrow shown in FIG. 2 at a predetermined circumferential velocity (process speed).

During the rotation process, a photosensitive drum 1*a* is uniformly charged to a predetermined polarity and a predetermined potential by a charging roller 2*a* and then receives image exposure from exposure means 3*a*. Thus, an electrostatic latent image corresponding to a yellow color component image that is an intended color image is formed on the photosensitive drum 1*a*. Then, the electrostatic latent image on the photosensitive drum 1*a* (on the image bearing member) is developed at a development position by a first developing device (yellow developing device) 4*a*. The electrostatic latent image is thus visualized on the photosensitive drum 1*a* as a yellow toner image.

The yellow toner image formed on the photosensitive drum 1*a* is transferred (primary transfer) onto the intermediate transfer belt 10 (onto the intermediate transfer member) while passing through a contact region (hereinafter referred to as a primary transfer region) between the photosensitive drum 1*a* and the intermediate transfer belt 10. For convenience of illustration, FIG. 2 shows only the primary transfer region (primary transfer nip region) of the first image-forming station (a) as T1.

Primary untransferred toner remaining on a surface of the photosensitive drum 1*a* is cleaned and removed by a cleaning device 5*a* serving as a recovery member and then utilized in an image forming process subsequent to charging.

Similarly, a magenta toner image in the second color, a cyan toner image in the third color, and a black toner image in the fourth color are formed in the respective image-forming stations and sequentially transferred onto the intermediate transfer belt 10. Thus, a synthetic color image corresponding to the intended col or image is obtained.

While passing through a secondary transfer region T2, all the four toner images in the respective colors on the intermediate transfer belt 10 are transferred at a time to a surface of a recording material P fed from feeding means 50, by means of a secondary transfer voltage applied to a secondary transfer roller 20 by a secondary transfer power supply 21 (secondary transfer). In this case, the secondary transfer region T2 refers to a contact region (secondary transfer nip region) formed between the intermediate transfer belt 10 and the secondary transfer roller 20. The secondary transfer roller 20 corresponds to a transfer member, and the secondary transfer power supply 21 corresponds to a first power supply unit.

Subsequently, the recording material P bearing the four toner images in the respective colors are introduced into a fixing unit 30, where the recording material P is heated and pressurized to melt, mix, and fix the toner in the four colors to the recording material P. The above-described operation forms a full-color print image.

Furthermore, a conductive brush 16 as a charging member evenly sprinkles and charges secondary untransferred toner (residual toner) remaining on the surface of the intermediate transfer belt 10 after the secondary transfer. Then, the residual toner is charged by the conductive roller 17 as a charging member. A charging unit includes the conductive brush 16 and the conductive roller 17. In this case, the secondary untransferred toner is charged to a polarity opposite to the regular charging polarity of toner by the conductive brush 16 and the conductive roller 17. Subsequently, in the primary transfer region, the toner is moved (transferred) from the intermediate transfer belt 10 to the photosensitive drum 1. The secondary untransferred toner thus attached to the photosensitive drum 1 is removed by a cleaning device 5 disposed in association with the photosensitive drum 1.

As shown in FIG. 2, the conductive brush 16 and the conductive roller 17 are provided downstream of the secondary transfer region T2 and upstream of the primary transfer region T1 of the intermediate image forming station a in the rotating direction of the intermediate transfer belt 10. The conductive brush 16 and the conductive roller 17, when supplied with currents by high-voltage power supplies 60 and 70, respectively, implement charging of the second untransferred toner on the intermediate transfer belt to the polarity opposite to the regular charging polarity of the toner. In this case, the high-voltage power supplies 60 and 70 correspond to a second power supply unit.

(Configuration of the Intermediate Transfer Belt)

The intermediate transfer belt 10 will be described below in detail.

The intermediate transfer belt 10 is tensed by tensing members 11, 12, and 13 and is rotationally driven, such that in the contact region in which the intermediate transfer belt 10 contacts the photosensitive drum 1 the intermediate transfer belt 10 moves in the same direction as a moving direction of the photosensitive drum 1 at substantially the same circumferential velocity as that of the photosensitive drum 1. The tensing members 11, 12, and 13 include a driver roller 11, a tension roller 12, and a secondary transfer opposite roller 13. Thus, the tensing members 11, 12, and 13 are hereinafter sometimes referred to as the driver roller 11, the tension roller 12, and the secondary transfer opposite roller 13. Furthermore, the secondary transfer opposite roller 13 corresponds to an opposite member provided opposite the secondary transfer roller 20, the conductive brush 16, and the conductive roller 17 via the intermediate transfer belt 10.

The intermediate transfer belt 10 is an endless, rotatable belt that is made conductive by adding a conducting agent to a resin material. The intermediate transfer belt 10 is tensed by three shafts including the driver roller 11, the tension roller 12, and the secondary transfer opposite roller 13, and tensed by the tension roller 12 at a tension equal to a total pressure of 60 N.

According to Embodiment 1, the intermediate transfer belt 10 is endless polyimide resin with a circumferential length of 700 mm and a thickness of 90 μm. The intermediate transfer belt 10 exhibits electronic conductivity as an electrical property and is characterized by a small variation in resistance value depending on the temperature and humidity in the atmosphere. The intermediate transfer belt 10 used in Embodiment 1 has a volume resistivity of $1\times10^{8}$ to $1\times10^{10}\Omega\cdot$cm and a circumferential resistance value of $1\times10^{8}\Omega$. The volume resistivity was measured using a resistivity measurement meter Hiresta UP (model MCP-HT450) manufactured by Mitsubishi Chemical Analyteck Co., Ltd with a ring probe UR (model MCP-HTP12). During the measurement, room temperature was set at 23° C., and room humidity was set at 50%, and a voltage of 500 V was applied for a measurement time of 10 sec.

Now, a method for measuring the circumferential resistance value of the intermediate transfer belt 10 will be described.

Figure 3A:
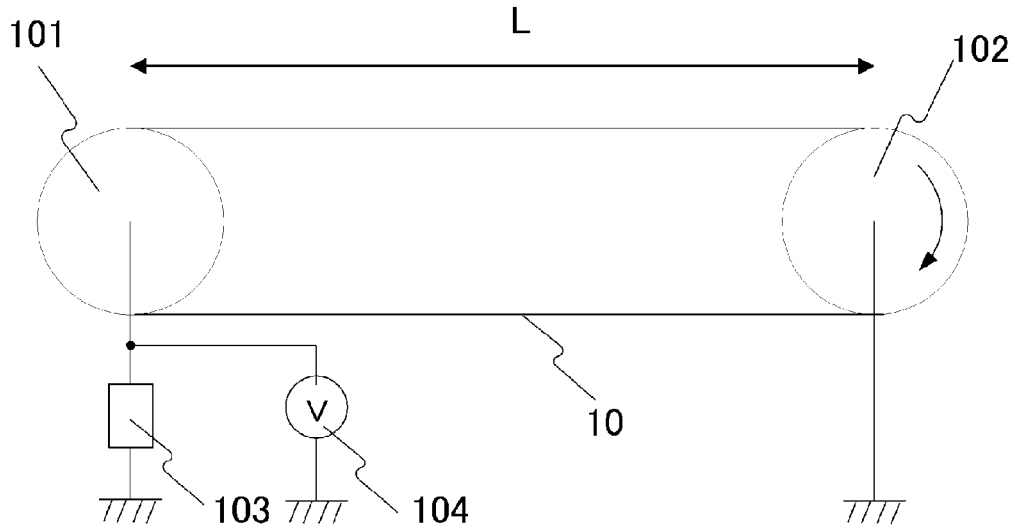
FIG. 3A is a diagram illustrating a circumferential resistance measuring jig for measuring the circumferential resistance of the intermediate transfer belt according to Embodiment 1.
Figure 3B:
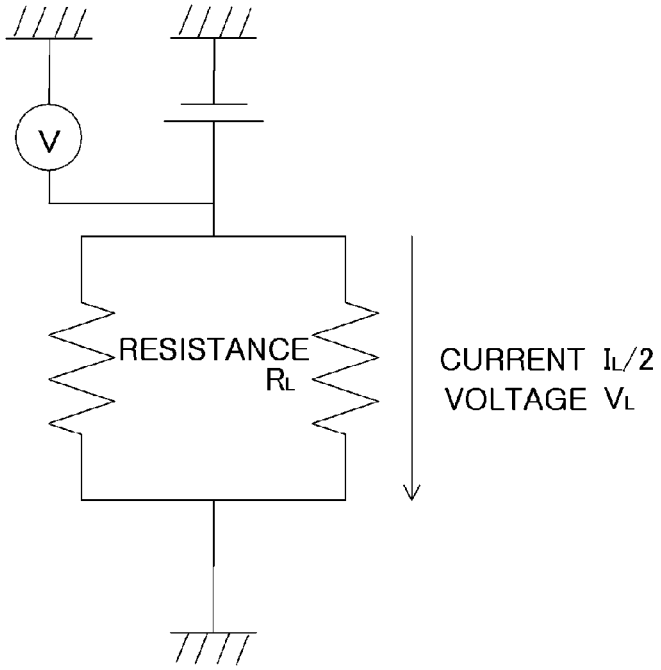
FIG. 3B is a diagram illustrating an equivalent circuit for a current path along which a current flows through the intermediate transfer belt in the circumferential direction thereof.

FIG. 3A is a diagram illustrating a circumferential resistance measuring jig for measuring the circumferential resistance of the intermediate transfer belt. FIG. 3B is a diagram illustrating an equivalent circuit for a current path along which a current flows through the intermediate transfer belt in the circumferential direction thereof.

The circumferential resistance was measured using the circumferential resistance measuring jig shown in FIG. 3A.

First, the configuration of the apparatus will be described. The intermediate transfer belt 10 to be measured is tensed by an inner surface roller 101 and a driver roller 102 so as to take up the slack thereof. The inner surface roller 101 formed of metal is connected to a high-voltage power supply (manufactured by TREK, INC.) 103, and the driver roller 102 is grounded. A surface of the driver roller 102 is covered with conductive rubber with sufficiently low resistance with respect to the intermediate transfer belt 10. The driver roller 102 rotates so that the intermediate transfer belt 10 moves at 100 mm/sec.

Now, a method for measurement will be described. With the driver roller 102 rotating the intermediate transfer belt 10 at 100 mm/sec, a predetermined current IL is applied to the inner surface roller 101, and a high-voltage power supply 103 connected to the inner surface roller 101 is used to monitor a voltage VL. On the assumption that a measurement system shown in FIG. 3A is an equivalent circuit shown in FIG. 3B, the circumferential resistance RL of the intermediate transfer belt 10 at the length of the distance L (in Embodiment 1, 300 mm) between the inner surface roller 101 and the driver roller 102 can be calculated to be RL=2VL/IL. The RL is converted into the circumferential length (in Embodiment 1, 700 mm) of the intermediate transfer belt 10 to determine the circumferential resistance. According to Embodiment 1, the material of the intermediate transfer belt 10 is polyimide resin, but may be any material provided that the material is a thermoplastic resin. For example, the material may be a material such as polyester, polycarbonate, polyarylate, acrylonitrile-butadiene-styrene copolymer (ABS), polyphenylene sulfide (PPS), or polyvinylidene difluoride (PVdF), or a mixture of any of these resins.

(Configuration of Each Member)

The secondary transfer roller 20 includes a nickel plated steel bar with an outer diameter of 8 mm covered with a foamed sponge member containing NBR (nitrile rubber) and epichlorohydrin rubber, as main components and having a thickness adjusted to 5 mm and exhibiting a volume resistivity of $10^{8}\Omega\cdot$cm, so that its diameter is totally 18 mm. Furthermore, the secondary transfer roller 20 is configured to be kept in contact with the intermediate transfer belt 10 under an applied pressure of 50 N so as to rotate in conjunction with rotation of the intermediate transfer belt 10. Additionally, while the toner on the intermediate transfer belt 10 is being secondarily transferred to recording material P, a voltage of 2,500 V from the secondary transfer power supply 21 is applied to the secondary transfer roller 20.

The conductive brush 16 and the conductive roller 17 are installed outside (on an outer circumferential side of) the intermediate transfer belt 10 as a charging member that charges the secondary untransferred toner.

The conductive brush 16 is formed of conductive fibers. A predetermined voltage is applied to the conductive brush 16 by the high-voltage power supply 60 to charge the secondary untransferred toner. Conductive fibers **16*a* forming the conductive brush 16 contain nylon as a main component, and carbon is used as a conducting agent. Each of the conductive fibers 16*a*** has a resistance value of $1\times10^{8}$ Ω/cm per unit length and a fineness of 300 T/60 F.

The conductive roller 17 is an elastic roller containing urethane rubber with a volume resistivity of $10^{9}\Omega\cdot$cm as a main component. The conductive roller 17 is configured to be pressurized by a spring (not shown in the drawings) at a total pressure of 9.8 N with respect to the secondary transfer opposite roller 13 via the intermediate transfer belt 10 and to rotate in conjunction with rotation of the intermediate transfer belt 10. Furthermore, a voltage of 1,500 V is applied to the conductive roller 17 by the high-voltage power supply 70 to charge the secondary untransferred toner. Embodiment 1 uses urethane rubber as the conductive roller 17 but is not limited to this. However, Embodiment 1 is not particularly limited and the conductive roller 17 may be NBR, EPDM (ethylene propylene rubber), epichlorohydrin, or the like.

(Operation of Cleaning)

A method for cleaning the intermediate transfer belt 10 in the above-described configuration will be described.

Figure 4:
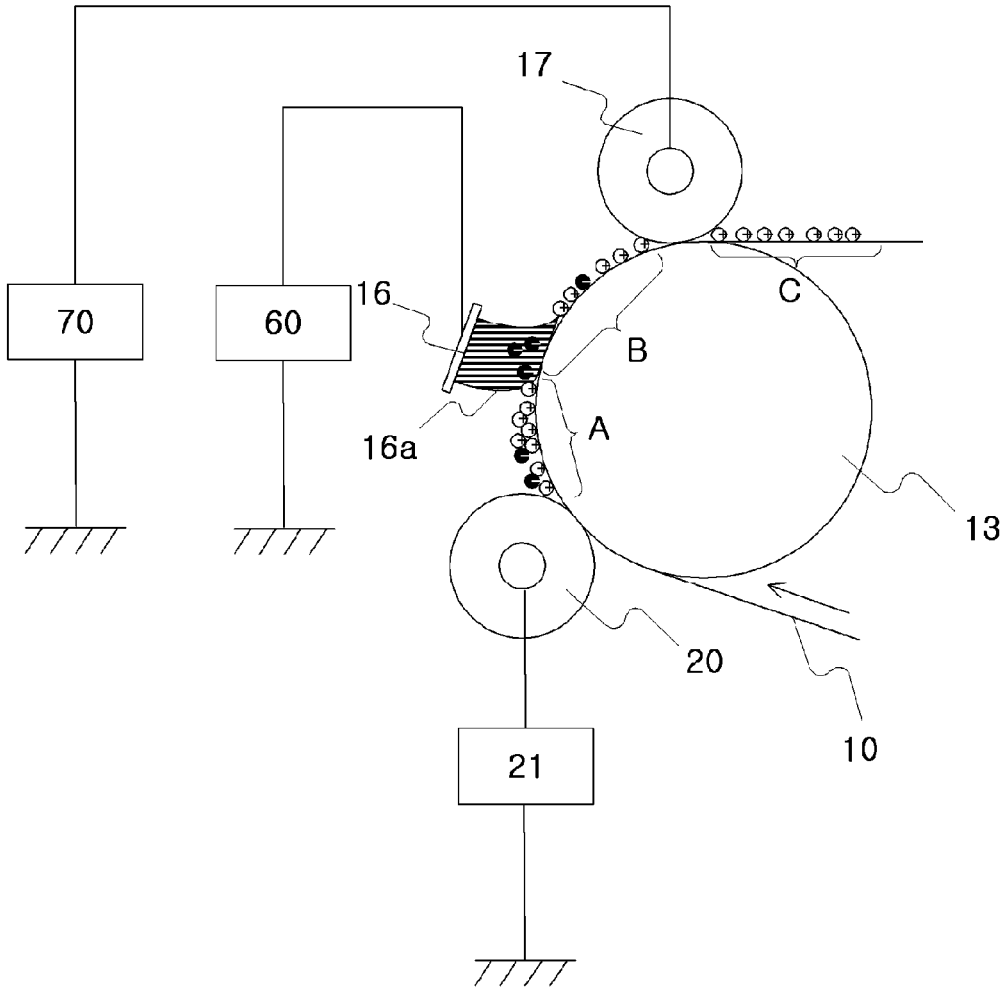
FIG. 4 is a diagram illustrating a method for cleaning the intermediate transfer belt according to Embodiment 1.

FIG. 4 is a diagram illustrating the method for cleaning the intermediate transfer belt 10.

According to Embodiment 1, the toner is charged to the negative polarity by the developing device 4 and used for development on the photosensitive drum 1 as described above. The toner is then primarily transferred from the photosensitive drum 1 to the intermediate transfer belt 10. Subsequently, the toner on the intermediate transfer belt 10 is secondarily transferred to the recording material P by the secondary transfer roller 20 with the positive polarity voltage applied thereto by the secondary transfer power supply 21. Thus, an image is formed.

As shown in FIG. 4, the secondary untransferred toner remaining on the intermediate transfer belt 10 after secondary transfer has a mixture of the positive polarity and the negative polarity due to the positive polarity voltage applied to the secondary transfer roller 20. Furthermore, recesses and protrusions on the surface of the recording material P cause the secondary untransferred toner to remain locally on the intermediate transfer belt 10 in a plurality of overlapping layers (the toner shown within a range A in FIG. 4).

The conductive brush 16, positioned upstream of the four image-forming stations in the rotating direction of the intermediate transfer belt 10, is fixedly disposed on the intermediate transfer belt 10 subjected to rotational movement. The conductive brush 16 is further located so that the level at which the conductive brush 16 penetrates the intermediate transfer belt 10 has a predetermined value. Thus, the secondary untransferred toner accumulated on the intermediate transfer belt 10 in the plurality of layers is mechanically sprinkled down to the height of substantially one layer due to a difference in circumferential velocity between the conductive brush 16 and the intermediate transfer belt 10 when the toner passes the conductive brush 16 (the toner shown within a range B in FIG. 4).

Furthermore, the positive polarity voltage is applied to the conductive brush 16 by the high-voltage power supply 60 to perform constant current control on the conductive brush 16. Thus, the secondary untransferred toner is charged to the positive polarity, which is opposite to the (regular) toner polarity during development, when passing the conductive brush 16. At this time, negative polarity toner having failed to be charged to the positive polarity is primarily collected by the conductive brush 16.

Subsequently, the secondary untransferred toner having passed the conductive brush 16 moves in the rotating direction of the intermediate transfer belt 10 and reaches the conductive roller 17. The positive polarity voltage has been applied to the conductive roller 17 by the high-voltage power supply 70. The secondary untransferred toner having passed the conductive brush 16 and been charged to the positive polarity is further charged upon passing the conductive roller 17. Thus, the secondary untransferred toner is provided with the optimum positive charge for moving to the photosensitive drum 1 at the primary transfer region (the toner shown within a range C in FIG. 4).

At the primary transfer region, the secondary untransferred toner provided with the optimum charge moves from the intermediate transfer belt 10 to the photosensitive drum 1, and is then collected by the cleaning device 5 for collecting the toner remaining on the photosensitive drum 1.

A summed current passed through the conductive brush 16 and the conductive roller 17 is determined for the reason described below.

A difference in potential applied to the conductive brush 16 depends on the value of a current flowing through the conductive brush 16. Since the positive polarity voltage is applied to the conductive brush 16, the negative polarity toner electrostatically attaches to the conductive brush 16 when the secondary untransferred toner with the mixture of both positive and negative polarities rushes into the conductive brush 16. Passage of a current of a large value through the conductive brush 16 leads to a significant difference in potential between the tip and base of the conductive brush 16. This increases a force electrostatically attracting the toner, attaching the secondary untransferred toner to the conductive brush 16 from the tip to base thereof. In contrast, passage of a current of a small value through the conductive brush 16 leads to an insignificant difference in potential between the tip and base of the conductive brush 16. This reduces the force electrostatically attracting the toner and thus the amount of toner attached to the base of the conductive brush 16.

Figure 5:
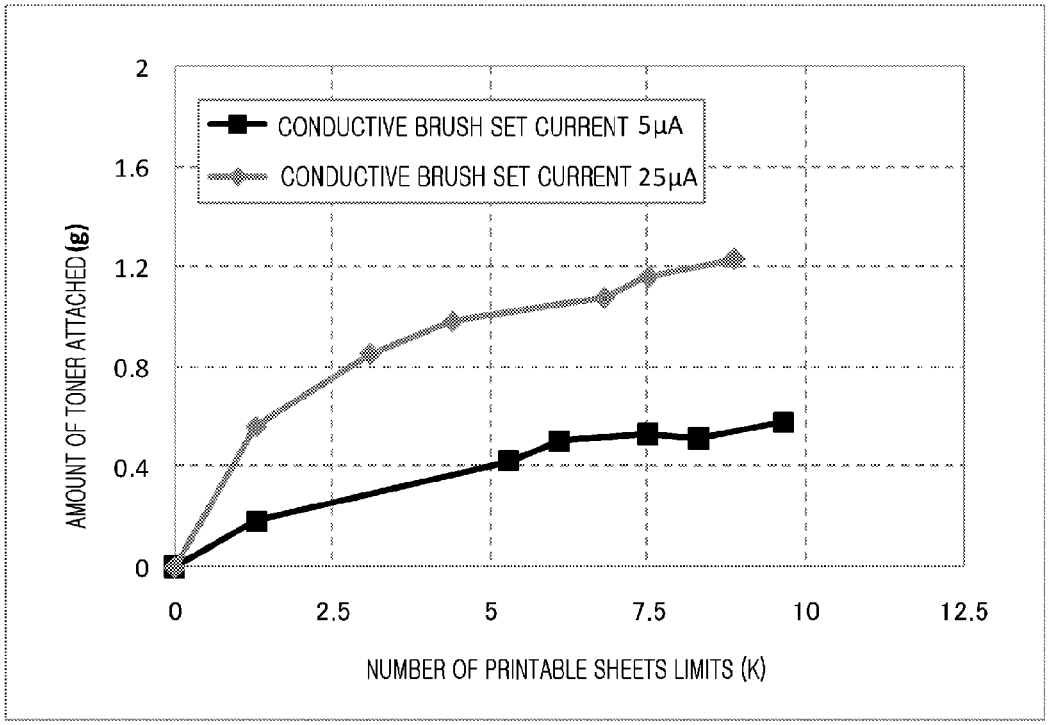
FIG. 5 is a diagram showing a relation between a set current for a conductive brush and the amount of toner attached according to Embodiment 1.

FIG. 5 is a diagram showing the results of experiments on the relation between a set current for the conductive brush 16 and the amount of toner attached.

With a 5-μA or 25-μA current applied as a set current for the conductive brush 16, a printing operation (an image-forming operation or image formation) was repeated. When the 5-μA current was applied to the conductive brush 16, the amount of toner attached was halved compared to when the 25-μA current was applied to the conductive brush 16. This verifies the relation between the set current for the conductive brush 16 and the amount of secondary untransferred toner attached.

The toner offers higher resistance than the conductive brush 16. Thus, an increased amount of secondary untransferred toner attached raises the apparent resistance of the conductive brush 16, possibly precluding a predetermined current from being passed through the conductive brush 16. This reduces the amount of charge applied to the secondary untransferred toner by the conductive brush 16, and the secondary untransferred toner is insufficiently charged to the positive polarity. As a result, the cleaning may become faulty.

Thus, a smaller current passed through the conductive brush 16 more appropriately prevents the performance of the relevant members from being degraded. Furthermore, a smaller current passed through the conductive roller 17 more appropriately prevents the performance of the relevant members from being degraded.

Hence, the conductive brush 16 and the conductive roller 17 are desirably provided with the minimum current needed to allow the conductive brush 16 and the conductive roller 17 to achieve the functions thereof.

According to Embodiment 1, the summed current passed through the conductive brush 16 and the conductive roller 17 is 20 μA, the summed current serving as the minimum current needed to sufficiently charge the secondary untransferred toner to the positive polarity so as to move the secondary untransferred toner on the intermediate transfer belt 10 to the photosensitive drum 1 (which is performing a printing operation). Embodiment 1 uses this value for the set current for charging the secondary untransferred toner. This will be described below in detail.

Furthermore, while the secondary untransferred toner is not charged, a current (hereinafter referred to as a holding current) needs to be passed through the conductive brush 16 and the conductive roller 17 in order to restrain the toner held on the conductive brush 16 and the conductive roller 17 from falling down.

According to Embodiment 1, the holding current, serving as the minimum current needed to achieve this function, is 5 μA.

The state in which the secondary untransferred toner is not charged is, for example, a period from the beginning of a printing operation until the secondary untransferred toner reaches the conductive brush 16 and the conductive roller 17 or a period from completion of charging of all of the secondary untransferred toner on the intermediate transfer belt 10 until the printing operation ends.

Figure 6:
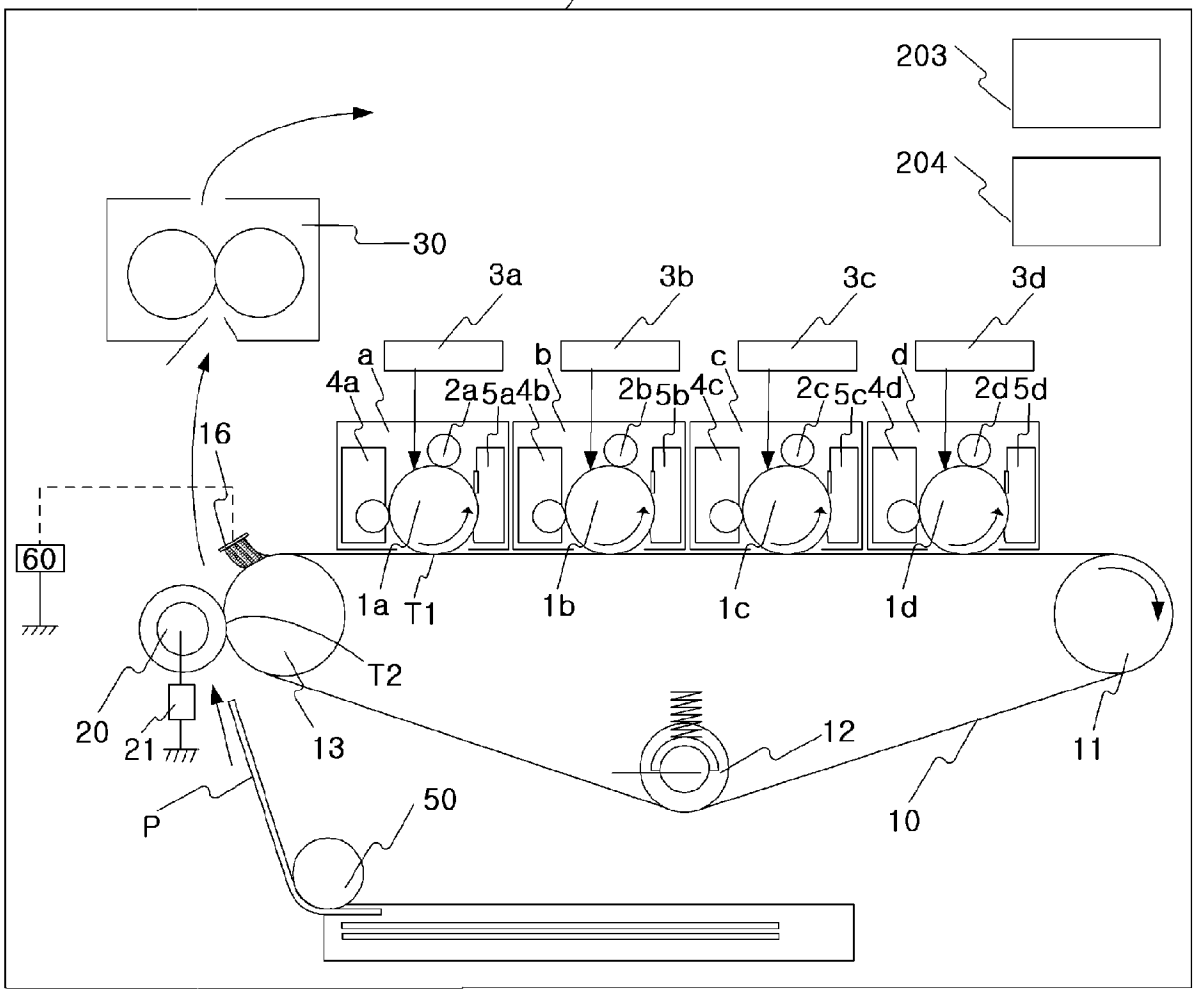
FIG. 6 is a cross-sectional view showing a general configuration of an image forming apparatus in another form.

FIG. 6 is a cross-sectional view showing a general configuration of an image forming apparatus in another form.

According to Embodiment 1, the conductive roller 17 is disposed downstream of the conductive brush 16 in the rotating direction of the intermediate transfer belt 10. The purpose of this disposition is to more uniformly charge the secondary untransferred toner after the toner passes the conductive brush 16. Thus, even without the conductive roller 17 as shown in FIG. 6, the secondary untransferred toner can be charged using only the conductive brush 16 when the amount by which the secondary untransferred toner is charged is within a predetermined range.

(Operation and Configuration of the Primary Transfer)

The operation and configuration of the primary transfer will be described below.

The intermediate transfer belt 10 is tensed by three shafts including the driver roller 11, the tension roller 12, and the secondary transfer opposite roller 13, and tensed by the tension roller 12 at a tension equal to a total pressure of 60 N. The tensing members 11, 12, and 13 are fixed using an insulating member so as to avoid being electrically connected to the image forming apparatus 200 main body. The secondary transfer roller 20, connected to the secondary transfer power supply 21, and the conductive brush 16 and conductive roller 17, connected to the high-voltage power supplies 60 and 70, are disposed on the tensing member 13 (opposite the tensing member 13) via the intermediate transfer belt 10.

During the primary transfer, a current is fed from the secondary transfer roller 20, the conductive brush 16, and the conductive roller 17 to the photosensitive drum 1 (primary transfer region) via the intermediate transfer belt 10, where the current flows in the circumferential direction of the intermediate transfer belt 10.

As a result, a yellow toner image formed on the photosensitive drum 1*a* is primarily transferred onto the intermediate transfer belt 10. A magenta toner image, a cyan toner image, and a black toner image on the photosensitive drums 1*b*, 1*c*, and 1*d*, respectively, are similarly primarily transferred onto the intermediate transfer belt 10.

Embodiment 1 is configured to pass a current through the intermediate transfer belt 10 in the circumferential direction thereof via the secondary transfer roller 20, the conductive brush 16, and the conductive roller 17, which are in contact with the intermediate transfer belt 10, to carry out the primary transfer at the primary transfer region. The summed current passed through the conductive brush 16 and the conductive roller 17 supplies a current sufficient for the primary transfer region during the primary transfer step (a current of a magnitude needed to carry out the primary transfer). The summed current passed through the conductive brush 16 and the conductive roller 17 charges the residual toner to the positive polarity. In this case, the high-voltage power supplies 60 and 70 are controlled by the control unit 204 to set (control) the summed current passed through the conductive brush 16 and the conductive roller 17. The secondary transfer power supply 21 is controlled by the control unit 204 to set (control) the current passed through the secondary transfer roller 20.

Figure 7:
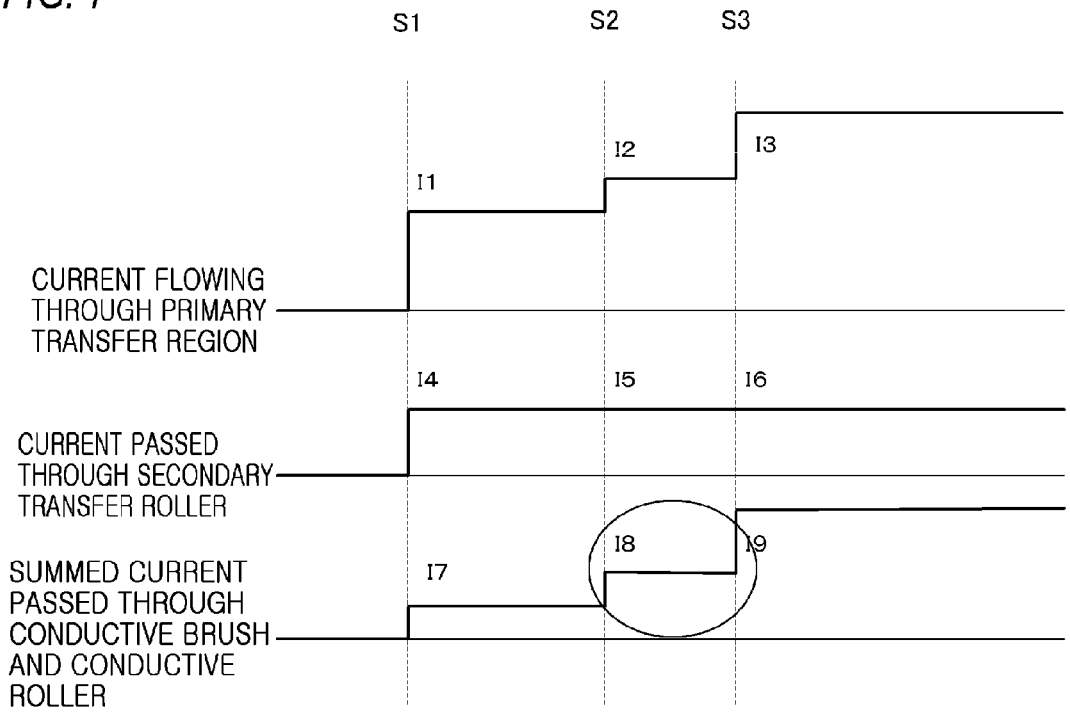
FIG. 7 is a chart showing timings when currents are applied during an image-forming process according to Embodiment 1.

FIG. 7 is a chart showing timings when currents are applied during an image-forming process according to Embodiment 1.

A series of operations from the beginning of a printing operation until the beginning of a secondary transfer step will be specifically described in use of FIG. 7.

In S1, a printing operation is started. To allow detection of the impedance of the secondary transfer region obtained when no recording material P is provided, a current I4 is passed through the secondary transfer roller 20. According to Embodiment 1, the current I4 is 10 μA. Furthermore, a holding current (current I7) for holding attached toner is passed through the conductive brush 16 and the conductive roller 17. According to Embodiment 1, the current I7 is 5 μA.

(Points)

In S2, a primary transfer step is started. To ensure a current needed for the primary transfer step, a summed current (current I8) is passed through the conductive brush 16 and the conductive roller 17. According to Embodiment 1, the current I8 is 10 μA. Furthermore, to allow the impedance of the secondary transfer region to be continuously detected, a current I5 passed through the secondary transfer roller 20 is kept in the state of S1 at 10 μA.

In S3, a secondary transfer step is started. To sufficiently charge the secondary untransferred toner to allow the secondary untransferred toner to move, at the primary transfer region, from the intermediate transfer belt 10 to the photosensitive drum 1, a summed current (I9) is passed through the conductive brush 16 and the conductive roller 17. According to Embodiment 1, the current I9 is 20 μA.

Furthermore, a current I6 passed through the secondary transfer roller 20 is kept in the state of S1 at 10 μA. At this time, a secondary transfer step is being carried out, and thus, the impedance of the recording material P and the toner is added to the impedance of the secondary transfer region. Consequently, a voltage higher than at S1 and S2 is applied to the secondary transfer region.

If the printing operation is continuously performed, the currents passed through the respective members remain in the state of S3. If the printing operation ends, since the primary transfer step has already ended when the secondary transfer step ends, no problem occurs when a change is made to the values of the currents passed through the secondary transfer roller 20, the conductive brush 16, and the conductive roller 17 after the secondary transfer step ends.

For convenience of description, a period from the beginning of the printing operation until the beginning of the primary transfer (the state of S1) is hereinafter referred to as an S1 interval. A period from the beginning of the primary transfer until the beginning of the secondary transfer (the state of S2, the primary transfer step) is hereinafter referred to as an S2 interval. Furthermore, a period from the beginning of the secondary transfer (the period of the secondary transfer step or a period from the beginning of the secondary transfer until the end of the printing operation) is hereinafter referred to as an S3 interval.

(Effects of Embodiment 1)

Effects of Embodiment 1 will be described below.

As described, Embodiment 1 is configured such that the summed current passed through the conductive brush 16 and the conductive roller 17 can be set as follows.

That is, the summed current passed through the conductive brush 16 and the conductive roller 17 is set, for the S2 interval, equal to the summed current (current I8) for supplying a sufficient current to the primary transfer region, and for the S3 interval, equal to the current I9 for charging the secondary untransferred toner to the positive polarity.

Thus, as shown in FIG. 7, a current I2 flowing through the primary transfer region during the S2 interval is larger than a current I1 flowing through the primary transfer region during the S1 interval and smaller than the current I3 flowing through the primary transfer region during the S3 interval.

This enables more appropriate primary transfer to be carried out while minimizing the degradation of the functions of the conductive brush 16 and the conductive roller 17.

Figure 12:
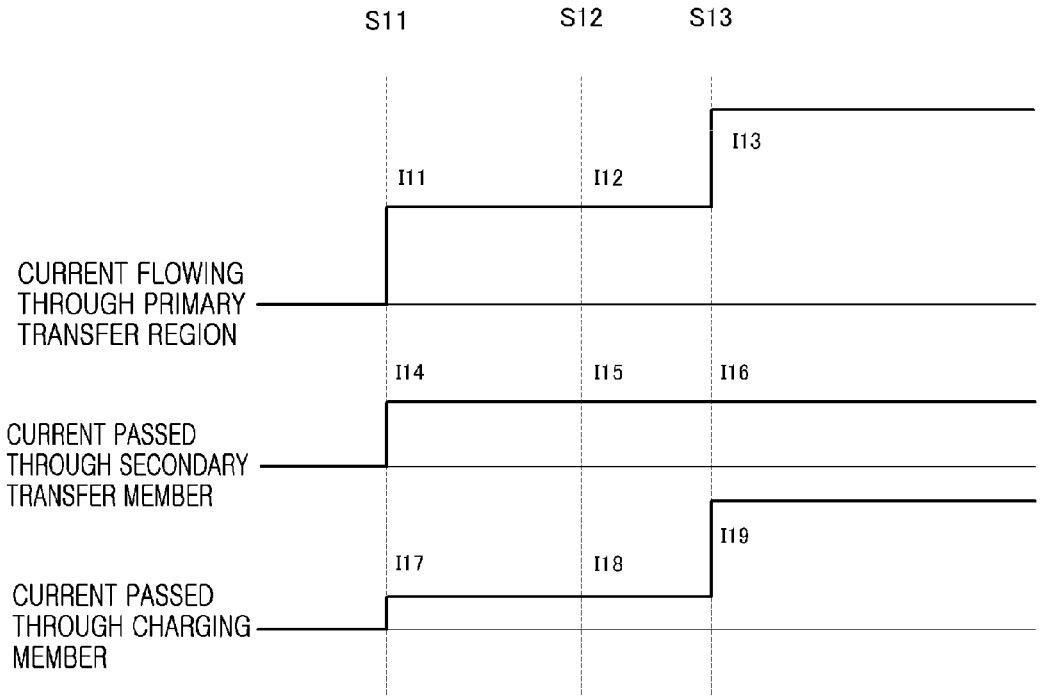
FIG. 12 is a chart showing timings when currents are applied during an image-forming process.

Now, as a comparative example, an operation performed from the beginning of an image-forming operation until the beginning of a secondary transfer step will be described with reference to a current application timing chart shown in FIG. 12.

In S11, a printing operation is started. To allow detection of the impedance of the secondary transfer region obtained when no recording material P is provided, a current I14 is passed through the secondary transfer roller. Furthermore, to hold attached secondary untransferred toner, a holding current I17 is passed through the charging member.

In S12, a primary transfer step is started. To allow the secondary transfer member and the charging member to continue the operation at S11, the same currents (current I15 and current I18) as those at S11 are passed through the secondary transfer member and the charging member.

In S13, a secondary transfer step is started. A voltage needed for the secondary transfer is calculated from the impedance of the secondary transfer region detected between S11 and S13, and a current I16 is passed through the secondary transfer region. To sufficiently charge the secondary untransferred toner to allow the secondary untransferred toner to move, at the primary transfer region, from the intermediate transfer belt to the photosensitive drum, a current I19 larger than I18 is passed through the charging member.

In S13, a current S13 flowing through the primary transfer region is the summed current of the current I16 and the current I119, and the current I19 needs to be large enough to sufficiently charge the secondary untransferred toner. Thus, the current I13 has a large value to allow a sufficient primary transfer efficiency to be achieved. However, at S12, a current I12 flowing through the primary transfer region is the summed current of the current I15 and the current I18, and the current I18 has the minimum value needed for holding the secondary untransferred toner on the charging member. Thus, the value of the current I12 is smaller than the value of the current I13. This may preclude a sufficient primary transfer efficiency from being achieved, resulting in an inappropriate image.

Hence, the voltage application timing chart in the comparative example has difficulty allowing a sufficient primary transfer efficiency to be achieved.

Figure 8:
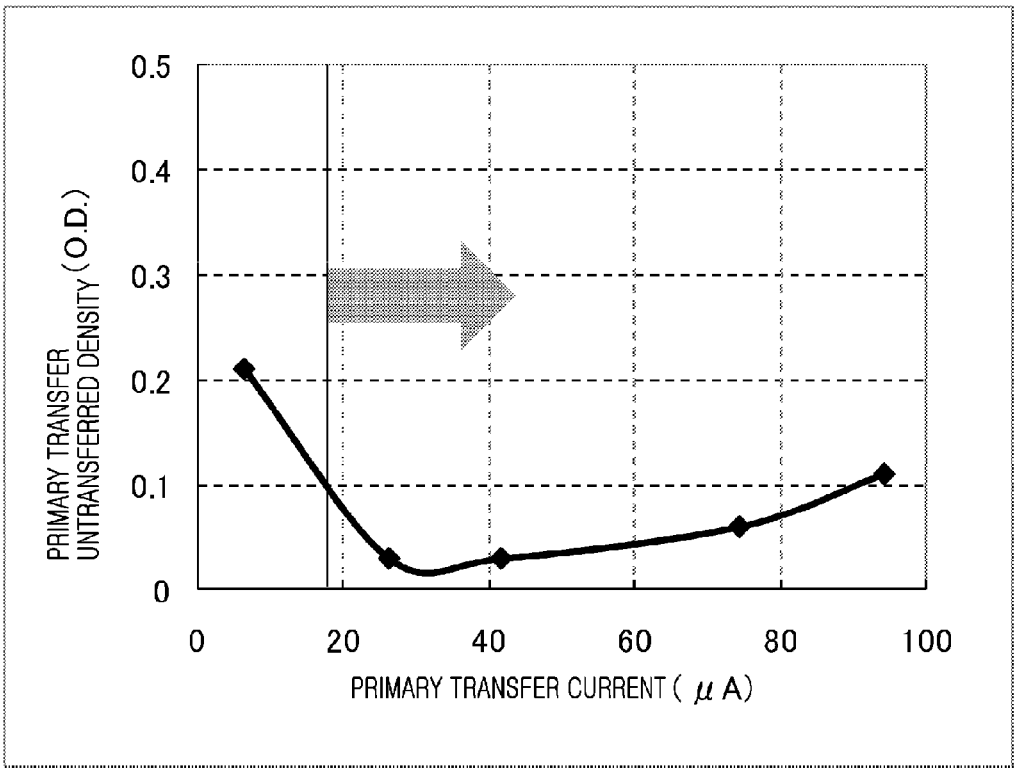
FIG. 8 is a diagram showing a current flowing through a primary transfer region and a primary transfer efficiency according to Embodiment 1.

FIG. 8 is a diagram showing the relation between the current flowing through the primary transfer region and the primary transfer efficiency for magenta in the configuration according to Embodiment 1. In FIG. 8, the axis of ordinate represents transfer efficiency and indicates the results of measurement of the primary untransferred density on the photosensitive drum 1*b* using a Macbeth transmission reflection densitometer (manufactured by GretagMacbeth, Inc.). The axis of abscissas represents the current flowing through the primary transfer region and indicates the result of measurement of the total of the current passed through the secondary transfer roller 20 and the summed current passed through the conductive brush 16 and conductive roller 17, or the total of the currents flowing through the photosensitive drums 1*a*, 1*b*, 1*c*, and 1*d*. Here, the primary transfer efficiency refers to the rate of a portion of the toner on the photosensitive drum 1 which moves to the intermediate transfer belt 10 when a toner image is transferred to the intermediate transfer belt 10.

For a sufficient primary transfer efficiency, the primary untransferred density is desirably 0.1 or less. FIG. 8 indicates that the current flowing through the primary transfer region needs to be 18 μA or more in order to achieve a sufficient primary transfer efficiency in the configuration according to Embodiment 1. The current flowing through the primary transfer region in order to achieve a sufficient primary transfer efficiency refers to a current of a magnitude needed to carry out the primary transfer.

When a primary transfer step is started at S2 on the timing chart in FIG. 7, a 10-μA current flows through the secondary transfer roller 20, and a 10-μA current flows through the conductive brush 16 and the conductive roller 17 as the summed current (current I8). Thus, when a primary transfer step is started at S2 in FIG. 7, a 20-μA current flows through the primary transfer region as a total current (current I2), that is, a current of 18 μA or more flows, which allows a sufficient primary transfer efficiency to be achieved. Consequently, the appropriate primary transfer can be carried out.

Thus, a 10-μA current can be passed through the secondary transfer roller 20 during any of the S1, S2, and S3 intervals. The current value of 10 μA is optimized for the secondary transfer step, and performing control such that a constant current flows though the secondary transfer roller is started before the secondary transfer step so as to allow the optimum 10-μA current to flow through the secondary transfer roller during the secondary transfer. Embodiment 1 enables the primary transfer step to be started during the control to allow formation of an image on the recording material to be started earlier.

Furthermore, the current passed through the conductive brush 16 and the conductive roller 17 is desirably as small as possible in order to prevent the functions of the relevant members from being degraded. Thus, only between S2, when the primary transfer is started, and S3, when the secondary transfer is started, (that is, during the S2 interval), the summed current (current I8) is passed through the conductive brush 16 and the conductive roller 17. The current I8 is set to the minimum value needed to achieve a sufficient primary transfer efficiency. This enables the minimization of degradation of the functions of the members of the conductive brush 16 and the conductive roller 17.

As described above, Embodiment 1 sets the current I8 and the current I9 to be the summed current passed through the conductive brush 16 and the conductive roller 17; the current I8 is intended to achieve a sufficient primary transfer efficiency during the S2 interval and the current I9 is intended to charge the secondary untransferred toner to the positive polarity during the S3 interval.

Thus, the current I2 flowing through the primary transfer region during the S2 interval can be set larger than the current I1 flowing through the primary transfer region during the S1 interval and set to have a magnitude needed to carry out the primary transfer. Furthermore, the current I2 can be set smaller than the current I3 flowing through the primary transfer region during the S3 interval.

This enables more appropriate primary transfer to be carried out while minimizing degradation of the functions of the conductive brush 16 and the conductive roller 17. As a result, an image forming apparatus providing images of higher grade can be implemented.

Embodiment 1 uses both the conductive brush 16 and the conductive roller 17 as a charging member that is an electric feeding member. However, one of the conductive brush 16 and the conductive roller 17 may be exclusively used provided that the above-described current values are met.

Figure 9:
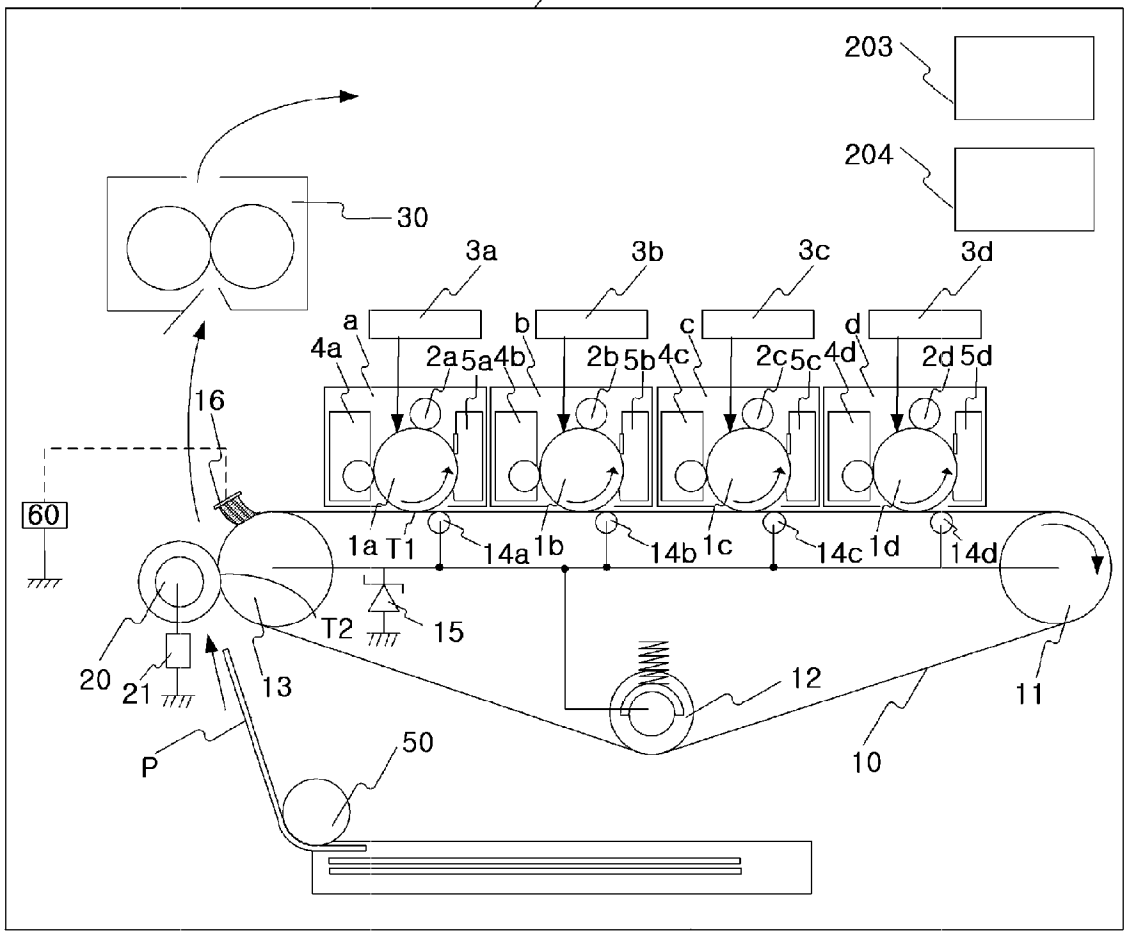
FIG. 9 is a cross-sectional view showing a general configuration of an image forming apparatus in another form.

FIG. 9 is a cross-sectional view showing a general configuration of an image forming apparatus in another form.

In the form shown in FIG. 9, metal rollers 14*a* to 14*d* are disposed in contact with an inner surface of the intermediate transfer belt 10 so that the tensing members 11, 12, and 13 tensing the intermediate transfer belt 10 are electrically connected to the respective metal rollers 14. Moreover, a voltage maintenance element 15 is connected to the tensing members 11, 12, and 13 and the metal rollers 14. In this case, each of the metal rollers 14 corresponds to a contact member that contacts a surface of the intermediate transfer belt 10 opposite to the surface thereof contacted by the corresponding photosensitive drum 1. The contact member is not limited to the metal roller as in Embodiment 1 but may be a conductive elastic roller.

The voltage maintenance element 15 is connected via the secondary transfer opposite roller 13 to a conductive path for grounding the intermediate transfer belt 10 so that, when a voltage equal to or higher than a predetermined voltage is applied, the voltage maintenance element 15 maintains the members connected to the voltage maintenance element 15 at the predetermined voltage. According to Embodiment 1, the voltage maintenance element is a Zener diode. Thus, when a breakdown voltage (predetermined voltage) is reached, a current flows through the Zener diode. If an excessive current flows through the secondary transfer roller 20 and the conductive brush 16, the metal rollers 14*a* to 14*d* can be maintained at the predetermined voltage, with an excessive current restrained from flowing into the primary transfer region.

FIG. 9 shows that the voltage maintenance element 15 is connected to the tensing members 11, 12, and 13 and the metal rollers 14, but Embodiment 1 is not limited to this configuration. The voltage maintenance element 15 may be connected to at least the secondary transfer opposite roller 13 among the tensing members 11, 12, and 13.

In such a configuration, a current flowing through the secondary transfer roller 20 and the conductive brush 16 partly passes through the intermediate transfer belt 10 in the circumferential direction thereof to the primary transfer region and partly passes from the secondary transfer opposite roller 13 through the metal rollers 14 to the primary transfer region. That is, a conductive path from the secondary transfer opposite roller 13 through the metal rollers 14 to the primary transfer region is added in a supplementary manner to the conductive path extending through the intermediate transfer belt 10 in the circumferential direction thereof to the primary transfer region. Thus, a current of a magnitude needed to carry out the primary transfer can be more reliably supplied to the primary transfer region (photosensitive drum 1).

According to Embodiment 1, as many metal rollers 14 as the photosensitive drums 1 are provided so that each of the metal rollers 14 corresponds to one of the photosensitive drums 1. However, Embodiment 1 is not limited to this configuration. Any configuration may be used provided that the current flowing through the secondary transfer roller 20 and the conductive brush 16 partly passes from the secondary transfer opposite roller 13 through the metal roller 14 to the primary transfer region. The number and arrangement of the metal rollers 14 are not particularly limited.

Furthermore, when as many metal rollers 14 as the photosensitive drums 1 are provided so that each of the metal rollers 14 corresponds to one of the photosensitive drums 1, each of the metal rollers 14 may be arranged downstream offset, in the rotating direction of the intermediate transfer belt 10, from a contact position (primary transfer region) between the corresponding photosensitive drum 1 and the intermediate transfer belt 10 by a predetermined amount. The predetermined amount as used herein is a length (distance) and may be set by being predetermined through experiments or the like.

It has been found out that, if the metal rollers 14 are provided so as to correspond to the respective photosensitive drums 1, the primary transfer can be more appropriately carried out when the metal rollers 14 are provided downstream of the primary transfer region in the rotating direction of the intermediate transfer belt 10 than when the metal rollers 14 are arranged as follows: each of the photosensitive drums 1 is provided opposite the corresponding metal roller 14 so as to form a nip region via the intermediate transfer belt 10 or the metal rollers 14 are provided upstream of the primary transfer region in the rotating direction of the intermediate transfer belt 10. The metal roller 14 provided opposite the photosensitive drum 1 may cause the photosensitive drum to be scraped, degrading the durability of the photosensitive drum 1. Additionally, the difference in potential between the photosensitive drum 1 and the intermediate transfer belt 10 is greater on the downstream side than on the upstream side. Thus, the above-described configuration allows the metal roller 14 to more easily supply a current to the photosensitive drum 1.

Furthermore, in Embodiment 1, the configuration has been described in which the four photosensitive drums are juxtaposed along the rotating direct ion of the intermediate transfer belt 10. However, the number of the photosensitive drums is not particularly limited provided that the image forming apparatus adopts the intermediate transfer system.

<Embodiment 2>

Embodiment 2 will be described below. Components of Embodiment 2 which are similar to the corresponding components of Embodiment 1 are denoted by the same reference numerals as those in Embodiment 1 and will not be described.

(Features of Embodiment 2)

Embodiment 2 provides a configuration in which a current is passed through an intermediate transfer belt 10 through the circumferential direction thereof via a secondary transfer roller 20, a conductive brush 16, and a conductive roller 17 which are in contact with the intermediate transfer belt 10, to carry out primary transfer at a primary transfer region. The configuration is characterized as follows.

A current passed through the secondary transfer roller 20 is intended to supply a sufficient current for a primary transfer step and to secondarily transfer the toner on the intermediate transfer belt 10 to a recording material P.

Figure 10:
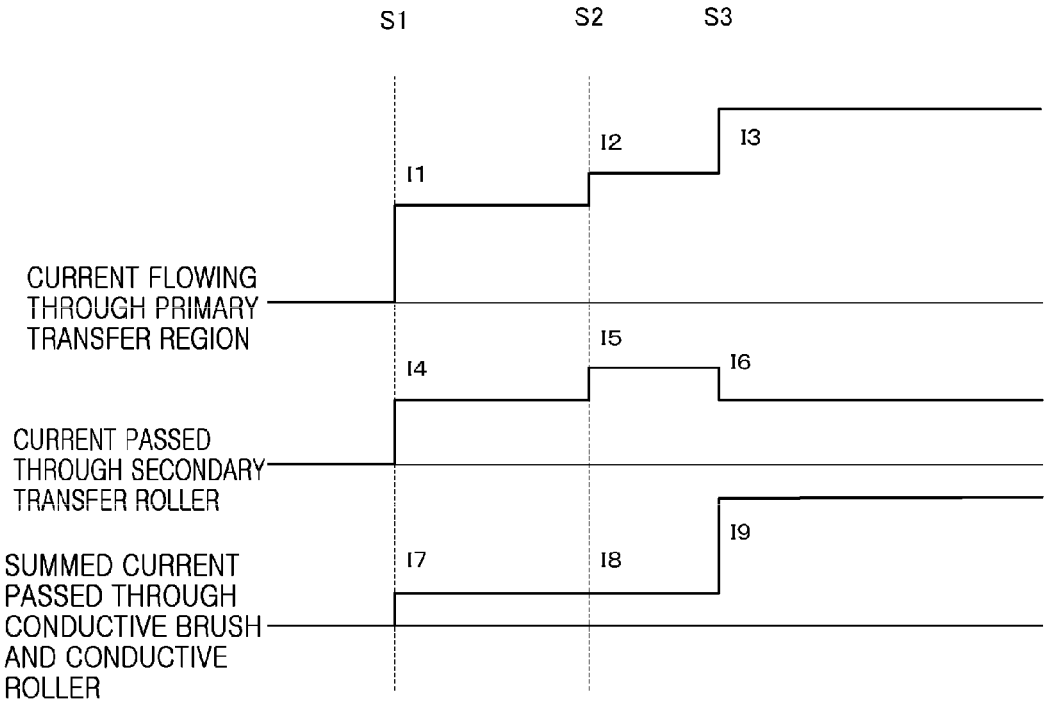
FIG. 10 is a chart showing timings when currents are applied during an image-forming process according to Embodiment 2.

FIG. 10 is a chart showing timings when currents are applied during an image-forming process according to Embodiment 2.

A series of operations from the beginning of an image-forming operation to the beginning of a secondary transfer step will be specifically described below with reference to FIG. 10.

In S1, a printing operation is started. To allow detection of the impedance of a secondary transfer region obtained when no recording material P is provided, a current I4 is passed through the secondary transfer roller 20. According to Embodiment 2, the current I4 is 10 μA. Furthermore, a holding current (current I7) for holding attached toner is passed through the conductive brush 16 and the conductive roller 17. According to Embodiment 2, the current I7 is 5 μA.

In S2, a primary transfer step is started. To ensure a current needed for the primary transfer step, a current I5 is passed through the secondary transfer roller 20. According to Embodiment 2, the current I5 is 15 μA. Furthermore, to allow the attached toner to be continuously held, a current I8 passed through the conductive brush 16 and the conductive roller 17 is kept in the state of S1 at 5 μA.

In S3, a secondary transfer step is started. To sufficiently charge the secondary untransferred toner to allow the secondary untransferred toner to move, at the primary transfer region, from the intermediate transfer belt 10 to the photosensitive drum 1, a summed current (I9) is passed through the conductive brush 16 and the conductive roller 17. According to Embodiment 2, the current I9 is 20 μA.

Furthermore, the current passed through the secondary transfer roller 20 is changed to a current I6 for secondarily transferring the toner on the intermediate transfer belt 10 to the recording material P. According to Embodiment 2, the current I6 is 10 μA.

If the printing operation is continuously performed, the currents flowing through the relevant members remain in the state of S3. If the printing operation ends, since the primary transfer step has already ended when the secondary transfer step ends, no problem occurs when a change is made to the values of the currents passed through the secondary transfer roller 20, the conductive brush 16, and the conductive roller 17 after the secondary transfer step ends.

(Effects of Embodiment 2)

Effects of Embodiment 2 will be described below.

According to Embodiment 2, the current passed through the secondary transfer roller 20 is set, for the S2 interval, equal to the current (current I5) for supplying a sufficient current for the primary transfer step, and for the S3 interval, equal to the current (current I6) for secondarily transferring the toner on the intermediate transfer belt 10 to the recording material P. The difference between the current I6 and the current I5 is smaller than the difference between the current I9 and the current I8.

Thus, as shown in FIG. 10, a current I2 flowing through the primary transfer region during the S2 interval is larger than a current I1 flowing through the primary transfer region during the S1 interval and smaller than a current I3 flowing through the primary transfer region during the S3 interval.

This enables more appropriate primary transfer to be carried out while minimizing degradation of the functions of the secondary transfer roller 20.

The current flowing through the primary transfer region needs to be 18 μA or more in order to achieve a sufficient primary transfer efficiency in the configuration according to Embodiment 2. This is the same as the contents described in Embodiment 1 and will not be described below.

When a primary transfer step is started at S2 on the timing chart in FIG. 10, the current I5 flowing through the secondary transfer roller 20 is 15 μA, and the holding current (current I8) for the conductive brush 16 and the conductive roller 17 is 5 μA. Thus, when a primary transfer step is started at S2 in FIG. 10, a 20-μA current flows through the primary transfer region as a total current (current I2), that is, a current of 18 μA or more flows, which allows a sufficient primary transfer efficiency to be achieved. Consequently, the appropriate primary transfer can be carried out.

Furthermore, the current passed through the secondary transfer roller 20 is desirably as small as possible in order to prevent the functions of the relevant members frombeing degraded. Thus, the current I5 is passed through the secondary transfer roller 20 only during the S2 interval, that is, a period from the beginning (S2) of the primary transfer until the beginning (S3) of the secondary transfer. The current I5 is set to the minimum value needed to achieve a sufficient primary transfer efficiency. This enables the minimization of degradation of the functions of the members of the secondary transfer roller 20.

As described above, Embodiment 2 sets the current I5 and the current I6 to be the set currents passed through the secondary transfer roller 20; the current I5 is intended to supply a sufficient current to the primary transfer region during the S2 interval, and the current I6 is intended to secondarily transfer the toner on the intermediate transfer belt 10 to the recording material P during the S3 interval.

Thus, the current I2 flowing through the primary transfer region during the S2 interval can be set larger than the current I1, flowing through the primary transfer region during the S1 interval, to be a current of a magnitude necessary for carrying out the primary transfer, and also smaller than the current I3 flowing through the primary transfer region during the S3 interval.

This enables more appropriate primary transfer to be carried out while minimizing degradation of the functions of the secondary transfer roller 20. As a result, an image forming apparatus providing images of higher grade can be implemented.

Figure 11:
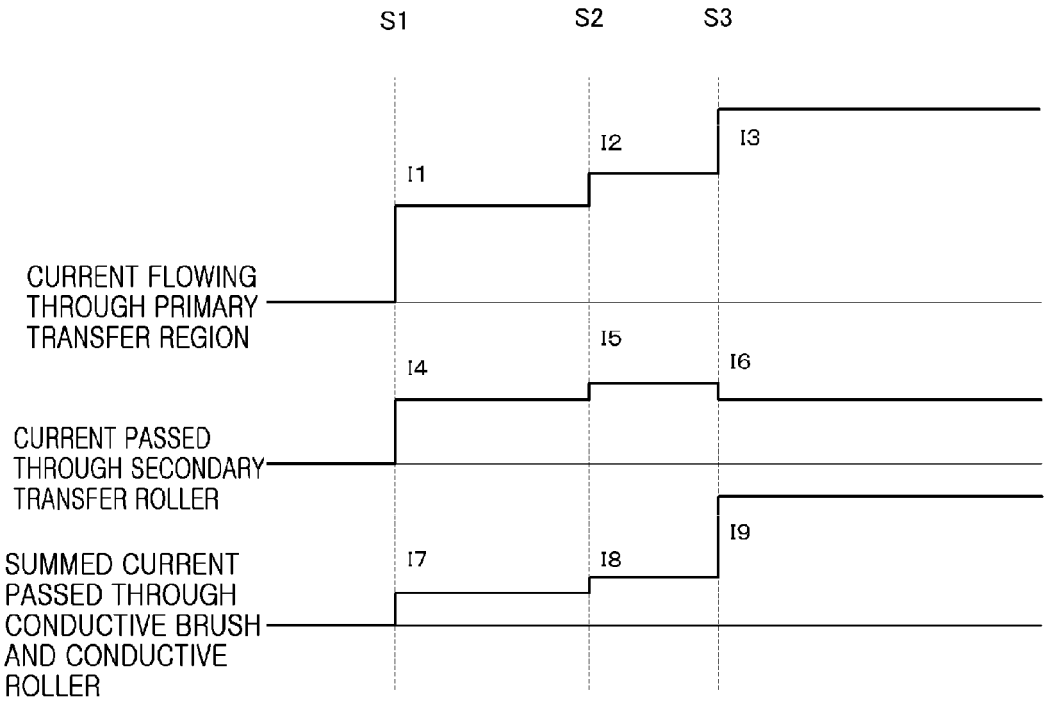
FIG. 11 is a chart showing timings when currents are applied during an image-forming process in another form.

FIG. 11 is a chart showing timings when currents are applied during an image-forming process in another form.

In the form shown in FIG. 11, the current I5 passed through the secondary transfer roller 20 during the S2 interval, that is, a period from the beginning (S2) of the primary transfer until the beginning (S3) of the secondary transfer is 7.5 μA. The summed current (current I8) passed through the conductive brush 16 and the conductive roller 17 during the S2 interval is 12.5 μA.

Thus, the current I2 flowing through the primary transfer region at the beginning of the primary transfer region is 20 μA.

This configuration enables more appropriate primary transfer to be carried out while minimizing degradation of the functions of the secondary transfer roller 20, the conductive brush 16, and the conductive roller 17. As a result, an image forming apparatus providing images of higher grade can be implemented. As described above, at least one of a first power supply unit (secondary transfer power supply 21) and a second power supply unit (high-voltage power supplies 60 and 70) may be controlled so as to provide, during the S2 interval, a current of a magnitude needed to carry out the primary transfer.

The present invention provides a configuration in which currents flowing through a secondary transfer member and a charging member for secondary untransferred toner flow to an image bearing member via an intermediate transfer member to carry out primary transfer, with the secondary untransferred toner moved to and collected by the image bearing member, the configuration enabling the optimum primary transfer to be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-229249, filed Oct. 16, 2012, which is hereby incorporated by reference herein in its entirety.

What is claimed is:

1. An image forming apparatus comprising:

an image bearing member on which a toner image is formed;

an intermediate transfer member that is endless and rotatable, the intermediate transfer member being disposed in contact with the image bearing member and forming a primary transfer region between the intermediate transfer member and the image bearing member, the toner image being primarily transferred, at the primary transfer region, to the intermediate transfer member;

a transfer member disposed in contact with the intermediate transfer member and forming a secondary transfer region between the transfer member and the intermediate transfer member;

a first power supply unit connected to the transfer member;

a charging member provided downstream of the secondary transfer region in a rotating direction of the intermediate transfer member and upstream of the primary transfer region to charge a residual toner remaining on the intermediate transfer member;

a second power supply unit connected to the charging member; and a control unit controlling at least one of the first power supply unit and the second power supply unit, wherein the control unit controls at least one of the first power supply unit and the second power supply unit so that a current supplied to the primary transfer region from a beginning of primary transfer until a beginning of secondary transfer has a magnitude larger than a magnitude of a current supplied to the primary transfer region from a beginning of image formation until the beginning of the primary transfer, and the first power supply unit and the second power supply unit pass a current from the transfer member and the charging member to the image bearing member via the intermediate transfer belt to carry out the primary transfer.

2. The image forming apparatus according to claim 1, wherein the control unit controls at least one of the first power supply unit and the second power supply unit so that a current supplied to the primary transfer region from the beginning of the primary transfer until the beginning of the secondary transfer has a magnitude needed to carry out the primary transfer.

3. The image forming apparatus according to claim 1, wherein the charging member charges the residual toner on the intermediate transfer member to a polarity opposite to a regular charging polarity, the image forming apparatus further comprising a collection member collecting toner remaining on the image bearing member and charged to the opposite polarity by the charging member to collect the residual toner on the intermediate transfer member, this residual toner having moved, at the primary transfer region, from the intermediate transfer member to the image bearing member.

4. The image forming apparatus according to claim 1, wherein the current supplied to the primary transfer region from the beginning of the primary transfer until the beginning of the secondary transfer is a current supplied to the primary transfer region when the secondary transfer is started, and the second power supply unit passes a current to the charging member in order to charge the residual toner on the intermediate transfer member to allow the residual toner on the intermediate transfer member to move, at the primary transfer region, from the intermediate transfer member to the image bearing member, so that the current supplied to the primary transfer region from the beginning of the primary transfer until the beginning of the secondary transfer has a magnitude smaller than a magnitude of the current supplied to the primary transfer region.

5. The image forming apparatus according to claim 1, wherein the control unit controls the second power supply unit so that a current flowing to the charging member from the beginning of the primary transfer until the beginning of the secondary transfer has a minimum magnitude needed to supply the primary transfer region with a current of a magnitude needed to carry out the primary transfer.

6. The image forming apparatus according to claim 1, wherein the control unit controls the first power supply unit so that a current flowing to the transfer member from the beginning of the primary transfer until the beginning of the secondary transfer has a minimum magnitude needed to supply the primary transfer region with a current of a magnitude needed to carry out the primary transfer.

7. The image forming apparatus according to claim 1, further comprising:

an opposite member provided opposite the transfer member and the charging member via the intermediate transfer member; and a voltage maintenance element connected to the opposite member to maintain the opposite member at a predetermined voltage when a voltage of a magnitude equal to or larger than a magnitude of the predetermined voltage is applied to the voltage maintenance element.

8. The image forming apparatus according to claim 7, further comprising a plurality of tensing members tensing the intermediate transfer member and one of which is the opposite member, wherein the voltage maintenance element is connected to at least the opposite member among the plurality of tensing members.

9. The image forming apparatus according to claim 7, wherein the voltage maintenance element is a Zener diode.

10. The image forming apparatus according to claim 7, further comprising a contact member contacting an opposite surface of the intermediate transfer member opposite to a surface of the intermediate transfer member contacted by the image bearing member, wherein the contact member is electrically connected to the opposite member so that, when the primary transfer is carried out, a current flowing from the transfer member and the charging member partly flows from the intermediate transfer member through the opposite member, the contact member, and the intermediate transfer member to the image bearing member in this order.

11. The image forming apparatus according to claim 10, wherein a plurality of image bearing members are provided along the rotating direction of the intermediate transfer member, and plural contact members equal in number to the number the image bearing members are provided so as to correspond to the respective image bearing members.

12. The image forming apparatus according to claim 11, wherein each of the contact members is disposed downstream offset, in the rotating direction of the intermediate transfer member, from a contact position between the corresponding image bearing member and the intermediate transfer member by a preset length.

13. The image forming apparatus according to claim 10, wherein the contact member is a metal roller.

* * * * *